US007661399B2

(12) United States Patent
Gregor et al.

(10) Patent No.: US 7,661,399 B2
(45) Date of Patent: Feb. 16, 2010

(54) CAMSHAFT ADJUSTING DEVICE

(75) Inventors: Matthias Gregor, Stuttgart (DE); Jens Meintschel, Esslingen (DE); Thomas Stolk, Kirchheim (DE); Alexander Von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 180 days.

(21) Appl. No.: 11/985,864

(22) Filed: Nov. 16, 2007

(65) Prior Publication Data

US 2008/0105079 A1 May 8, 2008

Related U.S. Application Data

(63) Continuation-in-part of application No. PCT/EP2006/004513, filed on May 13, 2006.

(30) Foreign Application Priority Data

May 19, 2005 (DE) ..... 10 2005 023 006

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 4,378,765 A * 4/1983 Abermeth et al. ..... 123/321
5,234,088 A 8/1993 Hampton
5,680,837 A 10/1997 Pierik
5,687,683 A 11/1997 Knoblauch
6,276,321 B1 8/2001 Lichti et al.

FOREIGN PATENT DOCUMENTS

| | | |
|---|---|---|
| DE | 31 33 289 | 3/1983 |
| DE | 100 84 408 | 8/2001 |
| DE | 201 05 838 | 9/2002 |
| DE | 102 13 825 | 11/2002 |
| DE | 102 05 034 | 8/2003 |
| EP | 0 687 804 | 12/1995 |
| EP | 1 533 483 | 11/2004 |

* cited by examiner

*Primary Examiner*—Zelalem Eshete
(74) *Attorney, Agent, or Firm*—Klaus J. Bach

(57) ABSTRACT

In a camshaft adjusting device including a positioning actuator for adjusting a phase position of a camshaft with respect to a crankshaft of an internal combustion engine, wherein the camshaft is driven by the crankshaft via a drive input, and a base drive torque of the camshaft is provided by a positioning actuator, a spring element is arranged between the camshaft and the crankshaft and has a spring torque selected so as to compensate for at least part of a mean load torque of a load unit connected to the camshaft to be driven thereby and at most only a part of the base drive torque.

12 Claims, 4 Drawing Sheets

CAMSHAFT ADJUSTING DEVICE

This is a Continuation-in-Part Application of pending international patent application PCT/EP2006/004513 filed May 13, 2006 and claiming the priority of German patent application 10 2005 023 006.7 filed May 13, 2006.

BACKGROUND OF THE INVENTION

The invention relates to a camshaft adjusting device including an actuator for adjusting the phase position of a camshaft with respect to a crankshaft of an internal combustion engine while maintaining a basic drive torque.

It is known that, in camshaft adjusting devices composed of a summing gearing and rotary actuator, the camshaft drive torque is backed by at the positioning input. A base torque which is to be present is provided by the actual camshaft torque divided by the transmission ratio of the summing gearing. The positioning actuator which is connected to the positioning input, for example an electric motor or a brake, must constantly apply the torque which is to be backed up by some component. If an auxiliary unit, for example a high-pressure injection pump, is additionally connected to the camshaft so as to be driven thereby, then the torque which is to be backed up also increases at the positioning input, as a result of which the positioning actuator must be larger. Power consumption and, in the case of a passive camshaft adjusting device having a brake, brake losses are correspondingly increased. It is therefore generally preferable for auxiliary units not to be driven by the camshaft.

U.S. Pat. No. 5,234,088 A1 discloses a camshaft adjusting device in which a clutch is connected in series between a drive input shaft and drive output shaft. A constant torque as a result of friction effects is superposed on cyclic torque fluctuations which are generated by the crankshaft operating the engine inlet and outlet valves and which are utilized for phase adjustment of the camshaft by virtue of the latter being correspondingly braked or accelerated. If the camshaft adjusting device is used in a drivetrain in which the torque fluctuations are small enough that a summed torque composed of fluctuations and constant torque is positive overall, it is possible for a spring element which is preloaded in one rotational direction to be arranged parallel to the camshaft adjusting device, so that the spring element completely or partially compensates the constant torque. In this way, the positive and negative components of the torque fluctuations are available entirely to the camshaft adjusting device for accelerating or braking the camshaft. In the case of a low constant torque, when the torque fluctuations result in negative components even in the summed torque, the spring element can be dispensed with. The spring element should, in addition to the torque generated by friction effects, also compensate for torques, which result from the operation of auxiliary units driven by the camshaft other than the valves.

It is the principal object of the present invention to provide a camshaft adjusting device which makes it possible to drive auxiliary units via the camshaft independently of an adjusting direction and without a significant increase in the torque to be backed up by the camshaft adjusting device.

SUMMARY OF THE INVENTION

In a camshaft adjusting device including a positioning actuator for adjusting a phase position of a camshaft with respect to a crankshaft of an internal combustion engine, wherein the camshaft is driven by the crankshaft via a drive input, and a base drive torque of the camshaft is provided by a positioning actuator, a spring element is arranged between the camshaft and the crankshaft and has a spring torque selected so as to compensate for at least part of a mean load torque of a load unit connected to the camshaft to be driven thereby and at most only a part of the base drive torque.

The spring element accommodates only a part of the total camshaft drive torque, composed of the base torque and the load torque. The load torque of a unit is generally composed of a rotational-speed-dependent mean torque with superposed oscillations, the amplitudes of which can likewise be dependent on the rotational speed of the camshaft. A torque, which comprises the rotational-speed-dependent mean load torque of the additional unit, and if appropriate, a part of the mean camshaft drive torque (base torque), is preferably compensated. If several units are to be driven by the camshaft, their summed torque is considered. Here, the spring element with its spring torque which engages the camshaft is configured such that at most a part of the base drive torque is compensated. The spring element is however always designed such that it cannot cancel out the entire camshaft drive torque, in contrast to known devices with restoring springs, whose function consists in firmly holding a camshaft adjusting device in predefined positions, such as an end stop or mean position, without active counteraction of the positioning actuator.

If an adjusting gearing is provided, the corresponding suitable spring torque is generated depending on between which shafts the spring element is arranged. If the spring element is situated for example between a positioning input of the adjusting gearing and the drive input shaft, the spring torque is identical to the torque which is to be compensated, in particular load torque, divided by the transmission ratio of the adjusting gearing. If the spring element is situated between the drive input shaft and the drive output shaft, the spring torque is equal to the torque which is to be compensated. The indirect arrangement of the spring element between the drive input shaft and the drive output shaft is to be understood to mean that the spring element is arranged between two of the shafts of the adjusting gearing, that is to say in particular between the positioning shaft and drive input shaft or the positioning shaft and drive output shaft. The spring element can alternatively be arranged directly between the drive input shaft and drive output shaft.

In the case of a camshaft adjusting device without a gearing, the spring element is connected directly between the drive input shaft and the drive output shaft. The positioning actuator imparts the entire camshaft drive torque.

In the case of an active positioning actuator, the spring element is advantageously configured such that a more favorable average fuel consumption is given in predefined operating ranges of the internal combustion engine. In the case of an active positioning actuator, the spring element is particularly advantageously configured such that a mean load torque, if appropriate divided by a transmission ratio of an adjusting gearing, can be compensated. An adjustment takes place merely by means of the torque of the positioning actuator, and in contrast to passive positioning actuators, the mean torque of the camshaft is not utilized for adjustment. An advantageous consumption saving is given in the corresponding operating ranges of the internal combustion engine.

In contrast to the active positioning actuator, in the case of a passive positioning actuator, the mean camshaft drive torque is utilized for adjustment, so that the compensation by means of the spring element should be only so pronounced that the adjusting properties of the camshaft adjusting device can still meet the requirements. This is advantageously achieved in that the spring element is configured such that at most a minimum mean load torque, if appropriate divided by a transmission ratio of an adjusting gearing, can be compensated. If the spring torque were higher, the adjusting speed would for example be impaired. In order to hold a phase position, the positioning actuator imparts the mean camshaft drive torque (base torque) including the load torque, divided by the transmission ratio of an adjusting gearing if one is provided. In the case of the passive positioning actuator, for example a brake, this generates a corresponding power loss. The power loss can be minimized by means of the spring element. With respect to a transmission ratio of any adjusting gearing which is provided, the resulting spring torque of the spring element, with respect to the same transmission ratio in the case of passive positioning actuators, is generally lower than the spring torque in the case of active positioning actuators.

In an advantageous first embodiment, an adjusting gearing is provided between the drive input shaft and camshaft, with the spring element being arranged between a positioning shaft of the adjusting gearing and the drive input shaft or between the positioning shaft and the camshaft or else between the drive input shaft and the drive output shaft. The adjusting gearing is preferably embodied as a summing gearing.

The active positioning actuator is preferably an electric motor. The electric motor can drive and brake in both rotational directions.

The passive positioning actuator may optionally be a brake, preferably a brake which operates without contacts, such as for example a hysteresis brake or an eddy-current brake. The adjusting gearing is then preferably in the form of a minus gearing.

In an alternative, second embodiment, in the case of a positioning actuator being arranged in series between the drive input shaft and the camshaft, the spring element is arranged between the drive input shaft and the camshaft. In the case of such a design without a gearing, the alternating torque of the camshaft is utilized for adjustment. The active positioning actuator can preferably be embodied as a hydraulic oscillating motor, for example with vane cells or as pressure pistons with helical toothing. The passive positioning actuator may be in the form of a hydraulic positioner with non-return valves or as a mechanical freewheel device.

In an advantageous design, the spring element is a torsion spring.

The arrangement according to the invention can be of particularly compact design if the spring element in the form of a torsion bar is disposed within a hollow camshaft. This refinement can be used both for camshaft adjusting devices without a gearing and also for camshaft adjusting devices with an adjusting gearing.

In a camshaft arrangement according to the invention, a spring element is arranged in the interior of the camshaft, wherein the spring element is preferably a torsion bar.

The invention will become more readily apparent from the following description of an exemplary embodiment thereof with reference to the accompanying drawings:

DESCRIPTION OF PARTICULAR EMBODIMENTS

In the figures, functionally equivalent elements are in each case designated by the same reference symbols.

Figure 1A:
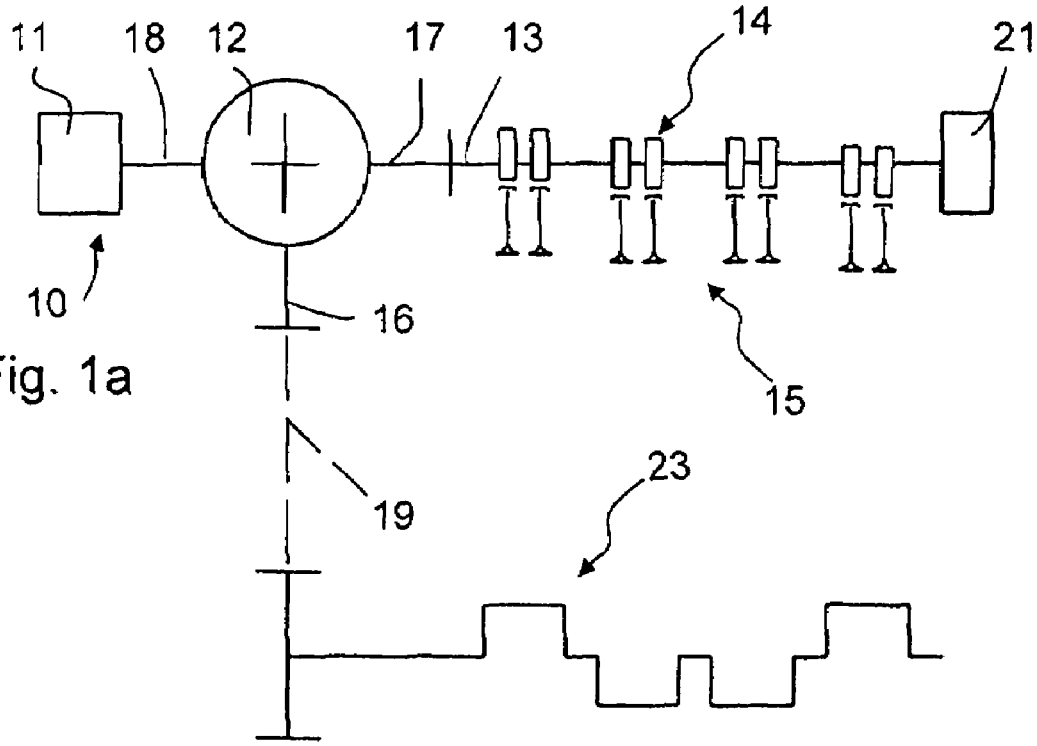
FIGS. 1*a* and 1*b* show schematically a preferred camshaft adjusting device with a summing gearing and a positioning actuator and an additional unit to be driven by the camshaft (a), and a schematic illustration of a preferred camshaft adjusting device without a gearing with a positioning actuator connected in series (b)
Figure 1B:
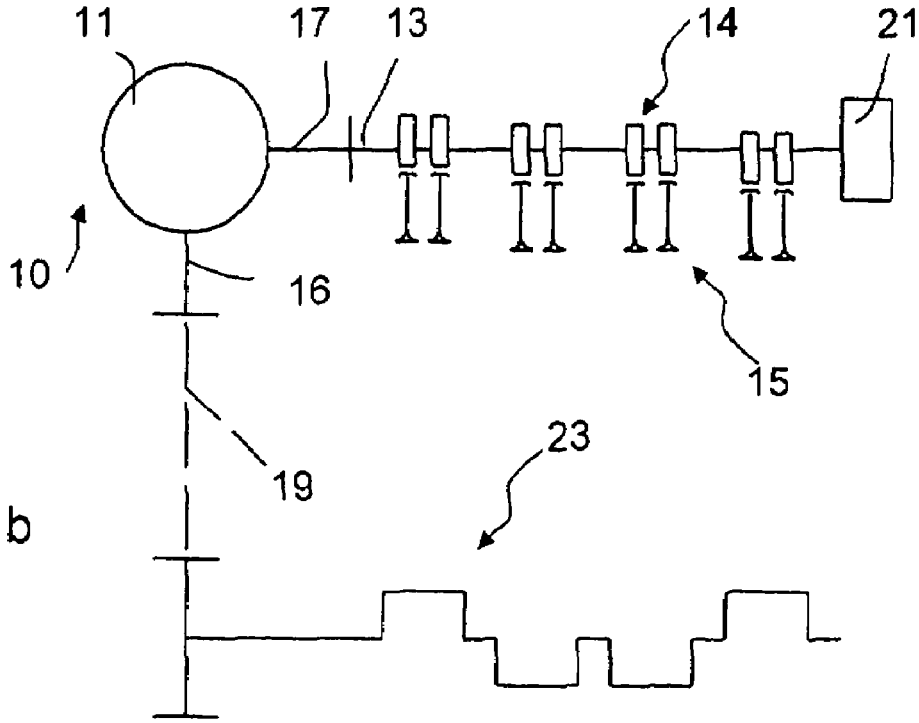

FIGS. 1*a* and 1*b* show, for better understanding of the invention, schematic illustrations of a camshaft adjusting device 10 having a summing gearing 12 and a positioning actuator 11 for controlling a camshaft 13, with an auxiliary unit 21 to be driven by the camshaft 13 (FIG. 1*a*). Preferably, the camshaft adjusting device 10 is without a gearing (FIG. 1*b*). In order to drive the unit 21, the camshaft 13 must transmit a load torque in addition to its base torque for actuating the valve arrangement 15, so that the camshaft drive torque rises if no further measures are taken. A crankshaft 23 drives a drive input shaft 16 of the camshaft adjusting device 10, and therefore the camshaft 13, via a drive input means 19, for example a chain or a belt. The camshaft 13 is connected to a drive output shaft 17 of the camshaft adjusting device 10. The camshaft 13 actuates with its cam arrangement 14 a valve arrangement 15 of an internal combustion engine (not illustrated). The positioning drive 11 shown in FIG. 1*a* interacts with a positioning shaft 18 with an adjusting gearing 12 which is arranged between the drive input shaft 16 and drive output shaft 17 in order to adjust a phase position between the crankshaft 23 and the camshaft 13 by actuating valves of the valve arrangement 15 earlier or later. In the embodiment without a gearing as per FIG. 1*b*, the positioning actuator 11 of the camshaft adjusting device 10 is in contrast connected in series with the crankshaft 23.

Figure 2A:
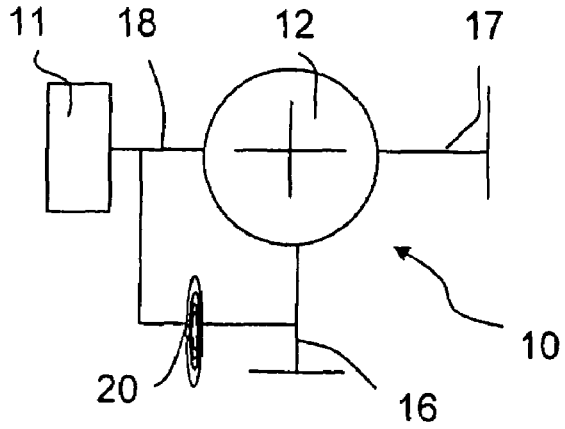
FIGS. 2*a*-2*d* show a preferred camshaft adjusting device with an adjusting gearing with a spring element between the positioning shaft and drive input shaft (a), with a spring element between the drive input shaft and drive output shaft (b), with a spring element between the positioning shaft and drive output shaft (c), and a preferred camshaft adjusting device without a gearing with a spring element between the drive input shaft and drive output shaft (d)
Figure 2B:
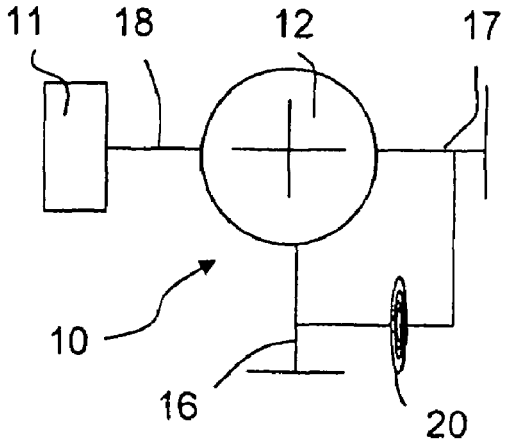
Figure 2C:
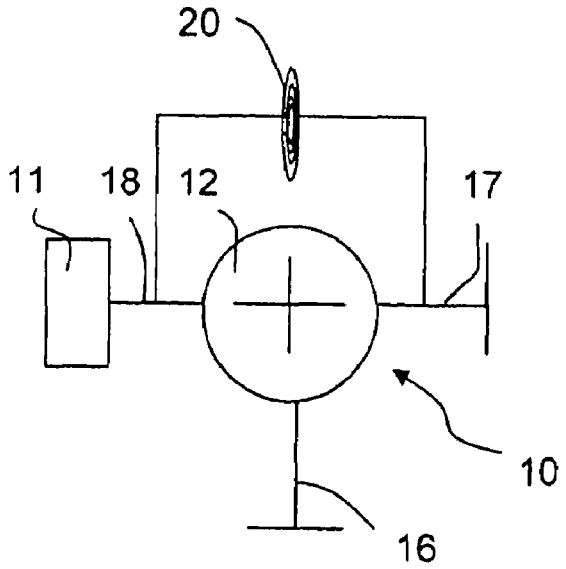

FIGS. 2*a*-2*d* show various embodiments of preferred camshaft adjusting devices 10 in which a spring element 20 is arranged in each case in a different way. FIGS. 2*a*-2*c* relate to a camshaft adjusting device 10 as per FIG. 1*a* with an adjusting gearing 12 which is preferably embodied as a summing gearing, while FIG. 2*d* relates to a camshaft adjusting device without a gearing as per FIG. 1*b*.

A spring element 20 is disposed in each case between two of the three shafts of the adjusting gearing 12 which is embodied as a summing gearing. In FIG. 2*a*, a passive or active positioning actuator 11 interacts via a positioning shaft 18 with the adjusting gearing 12 which is arranged between a drive input shaft 16, which is driven by a crankshaft 23 (FIG. 1), and a drive output shaft 17. A camshaft 13 is connected to the drive output shaft 17 (FIG. 1). A spring element 20 is arranged between the positioning shaft 18 and the drive input shaft 16, and biases the two against one another. An additional load torque of a unit 21 (FIG. 1) can thereby be compensated. The spring element 20 is configured such that its spring torque equals the load torque divided by a transmission ratio of the adjusting gearing 12. FIG. 2*b* shows an embodiment in which the spring element 20 is arranged between the drive input shaft 16 and the drive output shaft 17. The spring torque corresponds to the load torque. FIG. 2*c* shows an embodiment in which the spring element 20 is arranged between the positioning shaft 18 and the drive output shaft 17 and biases the two against one another. The spring torque again equals a load torque divided by the transmission ratio of the adjusting gearing 12.

Figure 2D:
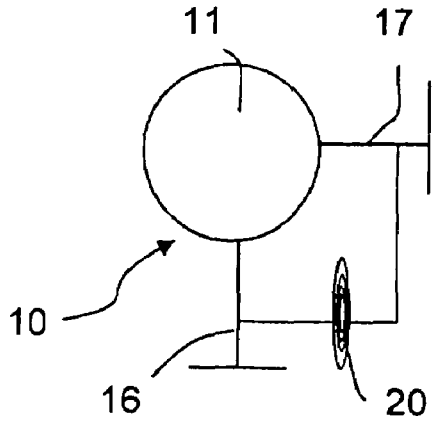

In the embodiment without a gearing as per FIG. 2*d*, the spring element 20 backs the drive input shaft 16 with respect to the drive output shaft 17, with the spring torque corresponding to the load torque.

Figure 3:
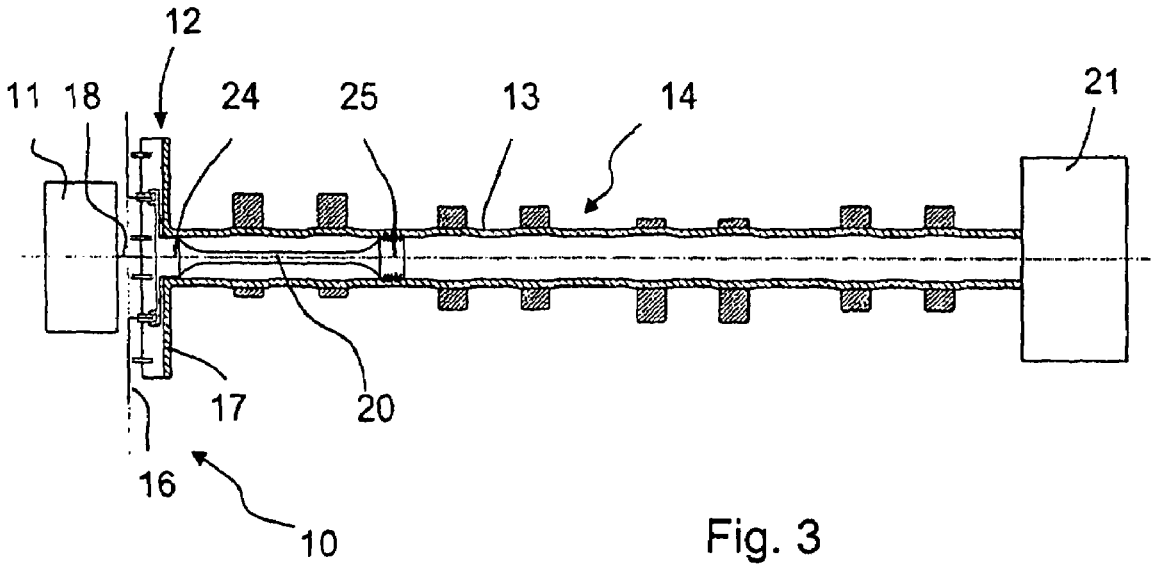
FIG. 3 shows an advantageous embodiment of the invention with a torsion bar as a spring element disposed in the camshaft.

A preferred embodiment of the camshaft adjusting device 10 and a preferred camshaft arrangement having a camshaft 13 with a cam arrangement 14 can be gathered from FIG. 3. The embodiment is suitable both for camshaft adjusting devices 10 with an adjusting gearing 12 and also for camshaft adjusting devices 10 without a gearing.

A camshaft adjusting device 10 comprises an adjusting gearing 12, which is preferably embodied as a summing gearing, with a positioning actuator 11 which is preferably a rotary actuator. The adjusting gearing 12 is a planetary gear set. A positioning shaft 18 is connected to a sun gear (not illustrated in detail) of the adjusting gearing 12, with which sun gear planet gears (not shown in detail) are engaged which are at the same time in engagement with an internal toothing of a drive input shaft 16 which is embodied as a ring gear and which concentrically surrounds the arrangement and whose drive output shaft 17 is adjoined by the camshaft 13.

Arranged in the interior of the camshaft 13 is a spring element 20 in the form of a torsion bar which engages with one end 24 the adjusting gearing 12, is connected to the drive input shaft 16 and is fixed with its opposite end in the camshaft 13.

Figure 4A:
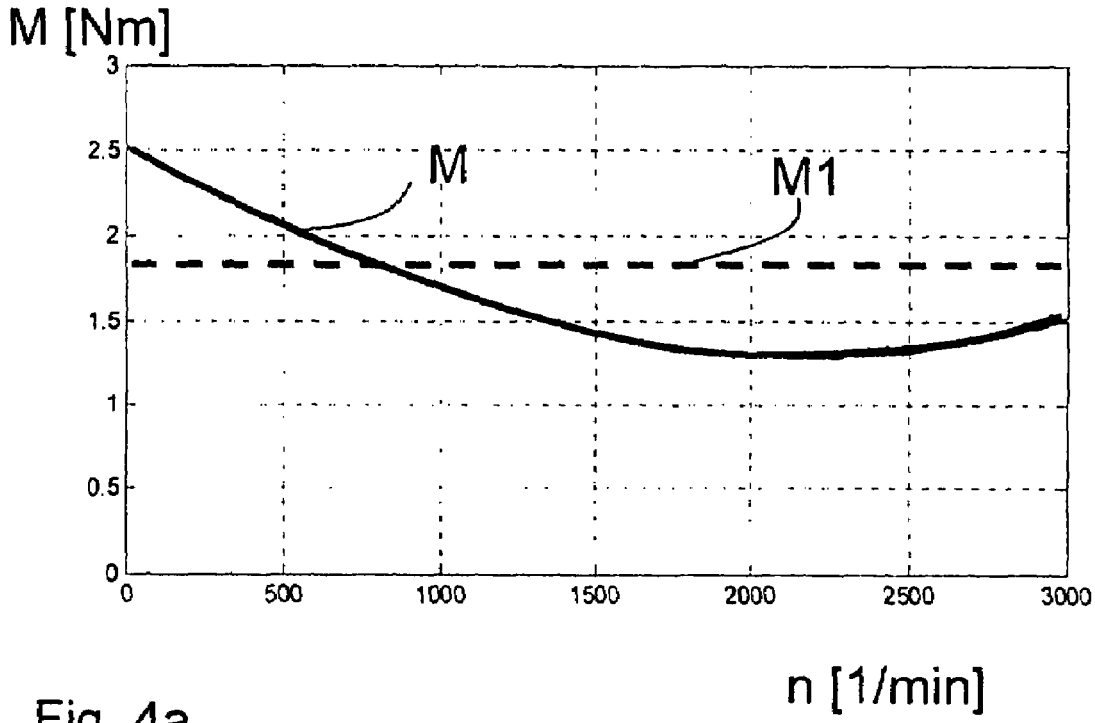
FIGS. 4*a* and 4*b* show the rotational-speed-dependent profile of a mean load torque of a unit which is to be driven by the camshaft, with a profile of a spring torque for active positioning actuators (a) and for passive positioning actuators (b).
Figure 4B:
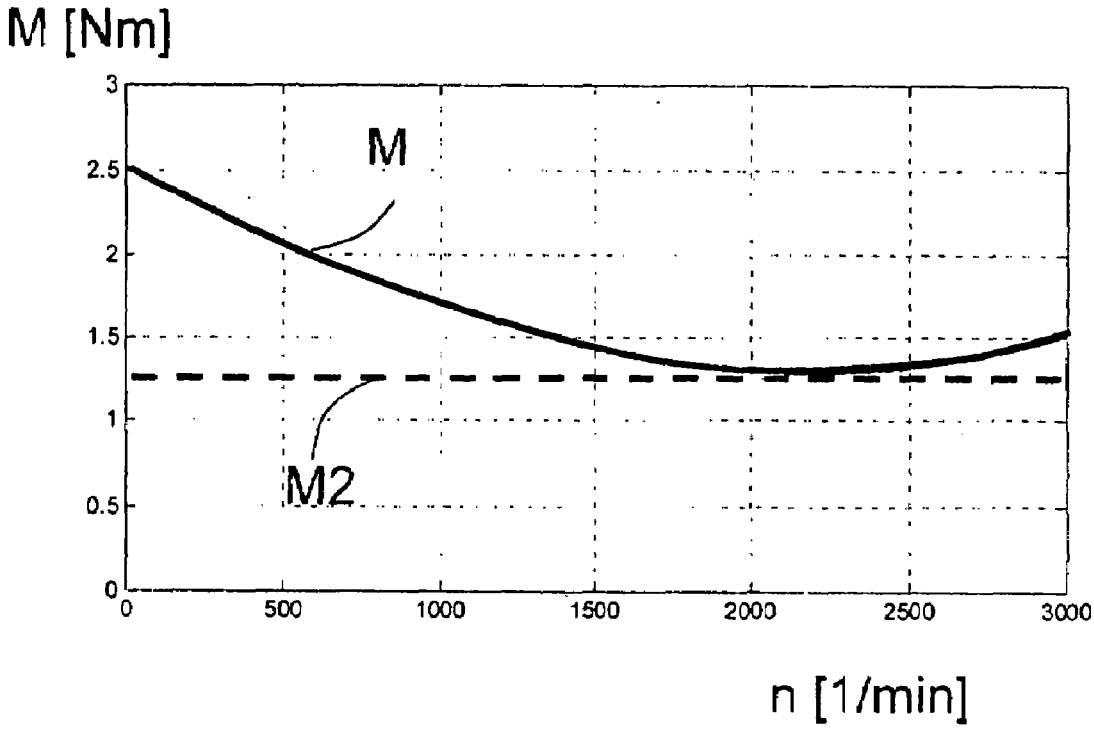

FIGS. 4*a* and 4*b* show diagrams, on the basis of which it is possible to explain how the spring element 20 with its spring torque in the preceding exemplary embodiments can be configured for a passive or active positioning actuator. The reference symbols of the components relate to the previously described exemplary embodiments.

In the diagrams, in each case the mean load torque M of the unit 21, or else of a plurality of units 21, is plotted as a function of the camshaft rotational speed n, in each case without superposed alternating torques. The mean load torque M is dependent on rotational speed and initially falls with respect to the rotational speed n in order to rise again slightly after a wide minimum. If the positioning actuator 11 is active, for example as an electric motor in the case of a camshaft adjusting device 10 with an adjusting gearing 12 or a hydraulic oscillating motor in the case of a camshaft adjusting device 10 without a gearing, then according to FIG. 4*a*, the spring element 20 is preferably configured such that its spring torque which acts on the camshaft 13 corresponds to the mean value M1 of the mean load torque M.

If, in contrast, the positioning actuator 11 is passive, for example as a brake in the case of a camshaft adjusting device 10 with an adjusting gearing 12 or a hydraulic positioning actuator 11 with non-return valves or with switchable freewheels in the case of a camshaft adjusting device 10 without a gearing, then according to FIG. 4*b*, the spring element 20 is preferably configured such that its spring torque which acts on the camshaft 13 corresponds at most to the minimum value M2 of the mean load torque M.

What is claimed is:

1. A camshaft adjusting device having a positioning actuator (11) for adjusting a phase position of a camshaft (13) with respect to a crankshaft (23) of an internal combustion engine, comprising a drive input (16) extending between the crankshaft (23) and the camshaft (13) for driving the camshaft (13), a positioning actuator for adjusting the position of the camshaft (13), a load unit (21) connected to the camshaft (23) to be driven thereby, a spring element (20) arranged between the camshaft (13) and the crankshaft (23) and being configured such that a mean load torque (M) of the load unit (21) can be at least partially compensated for.

2. The camshaft adjusting device as claimed in claim 1, wherein, with an active positioning actuator (11), the spring element (20) is configured for a more favorable average fuel consumption in predefined operating ranges of the internal combustion engine.

3. The camshaft adjusting device as claimed in claim 1, wherein, with an active positioning actuator (11), the spring element (20) is selected such that the spring torque compensates for a mean value (MI), which is obtained from a rotational-speed-dependent profile of the mean load torque (M) divided by a transmission ratio.

4. The camshaft adjusting device as claimed in claim 1, wherein, with a passive positioning actuator (11), the spring element (20) is selected such that the spring torque compensates for not more than a minimum value (M2) obtained from a rotational-speed-dependent profile of the mean load torque (M) divided by a transmission ratio.

5. The camshaft adjusting device as claimed in claim 1, wherein an adjusting gearing (12) is provided between the drive (16) and the camshaft (13), with the spring element (20) being arranged between a positioning shaft (18) of the adjusting gearing (12) and the drive input shaft (16) or between the positioning shaft (18) and the camshaft (13).

6. The camshaft adjusting device as claimed in claim 4, wherein the passive positioning actuator (11) is a brake.

7. The camshaft adjusting device as claimed in claim 3, wherein the active positioning actuator (11) is an electric motor.

8. The camshaft adjusting device as claimed in claim 1, wherein with a positioning actuator (11) arranged in series between the drive input shaft (16) and the camshaft (13), the spring element (20) is arranged between the drive input shaft (16) and the camshaft (13).

9. The camshaft adjusting device as claimed in claim 3, wherein the active positioning actuator (11) is a hydraulic oscillating motor.

10. The camshaft adjusting device as claimed in claim 4, wherein the passive positioning actuator (11) includes one of a non-return valve and a switchable freewheel.

11. The camshaft adjusting device as claimed in claim 1, wherein the spring element (20) is a torsion spring.

12. The camshaft adjusting device as claimed in claim 1, wherein the spring element (20) is a torsion bar disposed within the camshaft (13).

* * * * *